US006038997A

United States Patent [19]

Madden

[11] Patent Number: 6,038,997

[45] Date of Patent: Mar. 21, 2000

[54] APPARATUS FOR TALLYING THE AMOUNT OF TIME FOR WHICH A PAIR OF CONTACT LENSES HAVE BEEN WORN

[76] Inventor: Donna Madden, 40 Pearl St., Mystic, Conn. 06355

[21] Appl. No.: 08/932,434

[22] Filed: Sep. 17, 1997

[51] Int. Cl.[7] ..... G09F 9/00

[52] U.S. Cl. ..... 116/308; 116/316; 116/321; 206/5.1

[58] Field of Search ..... 116/306, 307, 116/308, 309, 311, 312, 316, 318, 321, 322, 323, 324; 206/5.1, 459.1, 5, 477, 478, 479, 482, 483, 495

[56] References Cited

U.S. PATENT DOCUMENTS

| | | | |
|---|---|---|---|
| 453,078 | 5/1891 | Deimel . | |
| 744,058 | 11/1903 | Frost . | |
| 1,454,263 | 5/1923 | Beskow . | |
| 1,705,050 | 3/1929 | Taylor | 206/478 |
| 2,183,428 | 12/1939 | McNary | 206/479 |
| 2,443,064 | 8/1948 | Bliss . | |
| 2,692,730 | 10/1954 | Wells . | |
| 4,823,944 | 4/1989 | Ryder | 206/5.1 |
| 4,909,382 | 3/1990 | Cuppari | 206/5.1 |
| 5,016,749 | 5/1991 | Kaye et al. | 206/5.1 |
| 5,063,679 | 11/1991 | Schwandt | 33/370 |
| 5,280,834 | 1/1994 | Berkley | 116/309 |
| 5,452,792 | 9/1995 | Zautke et al. | 206/5.1 |
| 5,564,361 | 10/1996 | Satterwhite | 116/308 |

FOREIGN PATENT DOCUMENTS

| | | | |
|---|---|---|---|
| 2154211 | 9/1985 | United Kingdom | 206/5.1 |

*Primary Examiner*—Andrew H. Hirshfeld
*Attorney, Agent, or Firm*—McCormick, Paulding & Huber LLP

[57] ABSTRACT

In an apparatus for tallying the length of time for which a pair of disposable contact lenses have been worn, a contact lens case is retained by a resilient member against a support member. A counter defining indicia corresponding to intervals of time is coupled for rotation to the support member. The indicia can be selectively aligned with a reference mark defined by the support member, thereby displaying the amount of time for which a particular pair of contact lenses have been worn.

7 Claims, 2 Drawing Sheets

APPARATUS FOR TALLYING THE AMOUNT OF TIME FOR WHICH A PAIR OF CONTACT LENSES HAVE BEEN WORN

FIELD OF THE INVENTION

The present invention relates generally to counting devices, and more particularly to an apparatus for tracking the wearable life left in a pair of disposable contact lenses.

BACKGROUND OF THE INVENTION

To avoid potential eye infections resulting from bacteria build up on a lens surface, as well as degradation of a wearer's eyesight due to lens deterioration; persons who wear disposable contact lenses must keep track of the amount of time for which the lenses have been worn. However, depending on the manufacturer or the type of lens chosen, a pair of disposable contact lenses may have a wearable life of several weeks or even months. If one does not record the date of first use, as time passes it can become difficult to recall how long a particular pair of disposable lenses have been worn.

Even when the date of first use is recorded, if the record is not conveniently situated and consulted on a regular basis, it is still possible to lose track of the length of time for which a pair of lenses have been worn. For example, the date upon which a pair of disposable contact lens should be discarded could occur while the wearer is traveling. If the lens wearer has not taken a record of how long the contact lenses have been worn with him, it is possible that the wearer will forget to discard the lenses and continue to wear them.

Based on the foregoing it is the general object of the present invention to provide a device for tallying the time period for which a pair of disposable contact lenses have been worn.

It is a more specific object of the present invention to provide such a device that is associated with the regular care of a pair of disposable contact lenses, thereby routinely reminding a wearer of the useful life remaining in the lenses.

SUMMARY OF THE INVENTION

The present invention meets these and other objects by providing an apparatus for tallying the length of time for which a pair of contact lenses have been worn. The apparatus includes a support member adapted to releasably retain a contact lens case, such as the type used to store a pair of contact lenses in a bath of cleaning solution when the lenses are not being worn. The apparatus also includes at least one counter coupled to the support member for indicating the length of time for which the pair of contact lenses have been worn. Whenever the contact lenses are removed for cleaning and stored in the lens case retained by the support member, the counter will remind the wearer of the wearable life left in the lenses.

In a preferred embodiment of the present invention, a resilient strap is coupled to the support member for overlapping the contact lens case and urging it against the support member, thereby releasably retaining the contact lens case against the support member. In addition, the counter preferably includes at least one dial rotatably coupled to the support member and having an upper surface defining indicia angularly spaced at fixed intervals around the counter's upper surface for indicating the amount of time for which the pair of contact lenses have been worn. The support member can also define a reference mark located adjacent to the counter with which the indicia on the upper surface of the dial can be aligned to provide the contact lens wearer with an accurate indication of the wearable life left in a particular pair of disposable contact lenses.

BRIEF DESCRIPTION OF THE DRAWINGS

A more complete understanding of the invention and many of the attendant advantages thereto will be readily appreciated as the same becomes better understood by reference to the following detailed description when considered in conjunction with the accompanying drawings wherein corresponding reference characters indicate corresponding parts throughout the several views of the drawings and wherein.

DETAILED DESCRIPTION OF THE PREFERRED EMBODIMENTS

Figure 1:
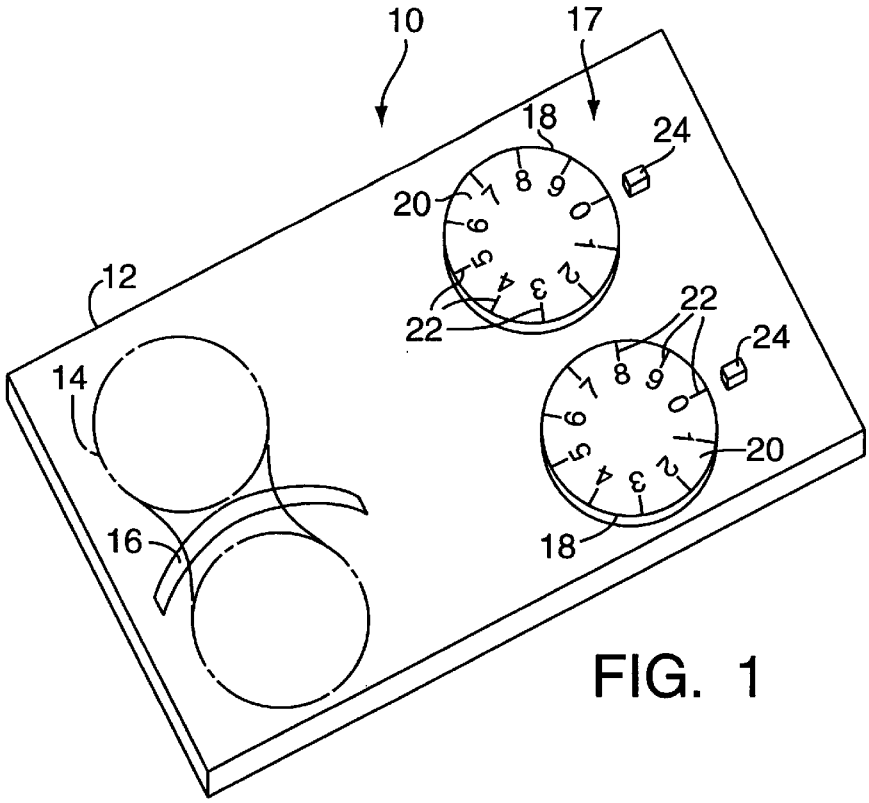
FIG. 1 is a perspective view of the apparatus of the present invention.
Figure 2:
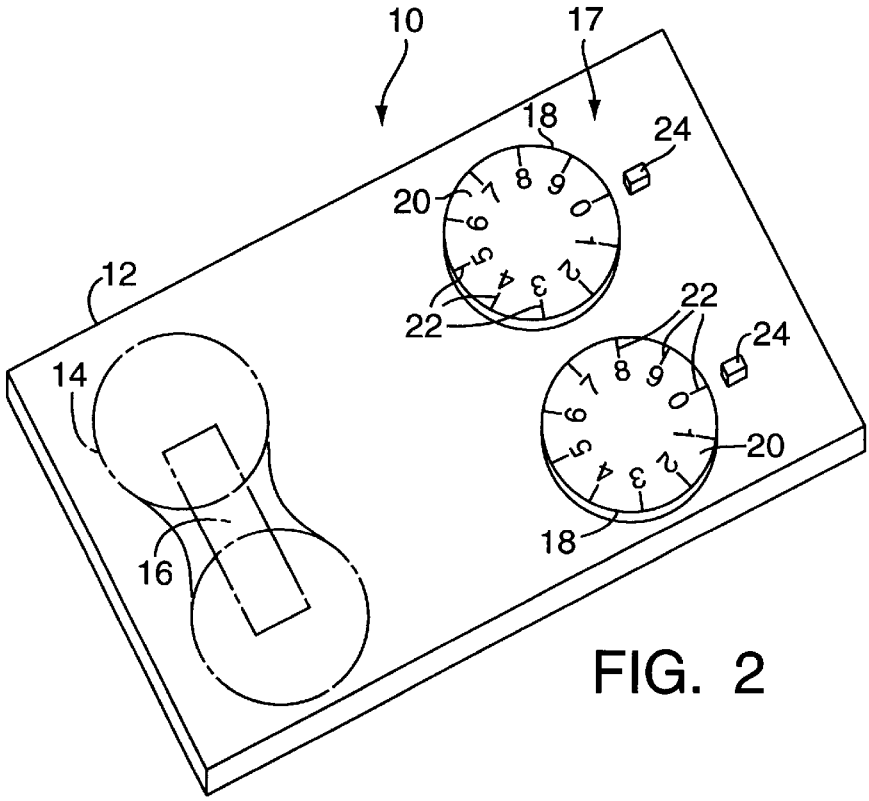
FIG. 2 is a perspective view of the apparatus of FIG. 1 showing an adhesive strip used to mount a contact lens case.
Figure 3:
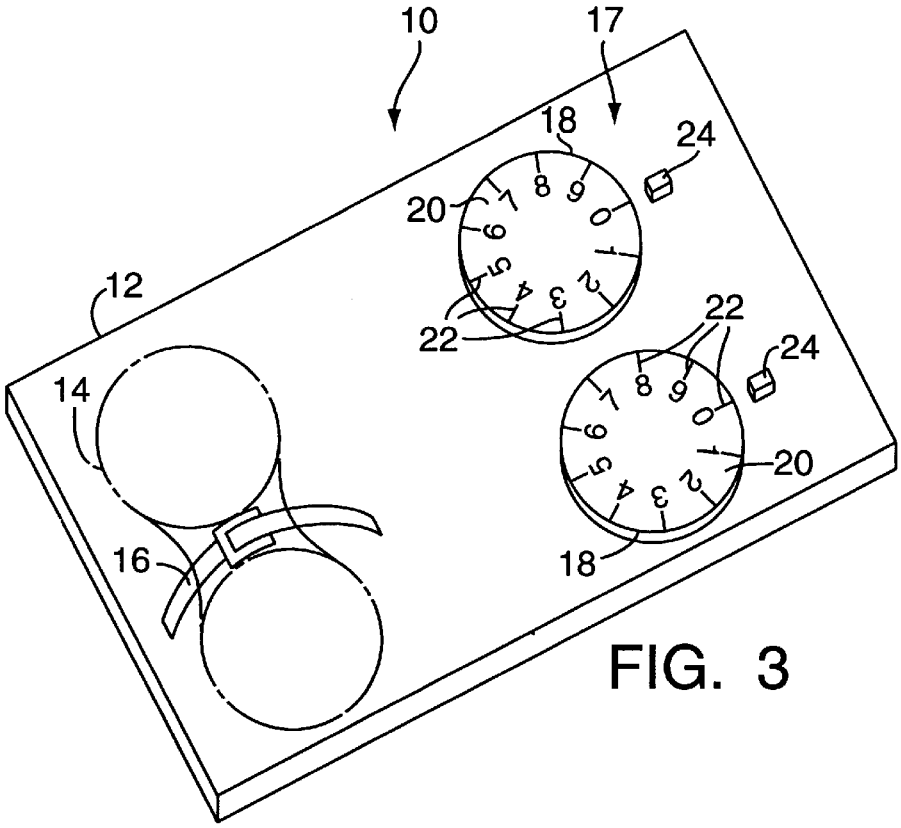
FIG. 3 is a perspective view of the apparatus of FIG. 1 showing an adjustable strap used to mount a contact lens case.

As shown in FIG. 1, an embodiment of the apparatus for tallying the length of time for which a pair of contact lenses have been worn is indicated generally by the reference numeral 10. The apparatus includes a support member 12, shown as an approximately flat plate, adapted to receive a contact lens case 14, shown in broken lines. The support member 12 is made from a suitable material, such as, but not limited to plastic. A resilient member 16 is coupled to the support member 12 and overlies the contact lens case 14 for releasably urging and retaining the case against the support member. A counter, generally designated as 17, is provided and includes a pair of dials 18 rotatably coupled to the support member 12. While a resilient member 16 has been shown and described, the present invention is not limited in this regard as other means for releasably retaining the contact lens case 14 against the support member 12, such as an adhesive strip, FIG. 2, hook and loop fasteners, or an adjustable strap, FIG. 3, can be substituted without departing from the broader aspects of the present invention.

Still referring to FIG. 1, each dial 18 of the counter 17 includes an upper surface 20 defining indicia 22 angularly positioned at fixed intervals around the circumference of the upper surface. The indicia 22 corresponds to intervals of time for indicating how long the pair of disposable contact lenses have been worn. To further facilitate an accurate indication of the time for which the lenses have been worn, the support member 12 defines two reference marks 24, one positioned adjacent to each of the dials 18. The dials 18 can be selectively rotated to align the indicia 22 with the reference marks 24 providing a readily discernible indication of the amount of time for which the pair of disposable contact lenses have been worn.

Figure 4:
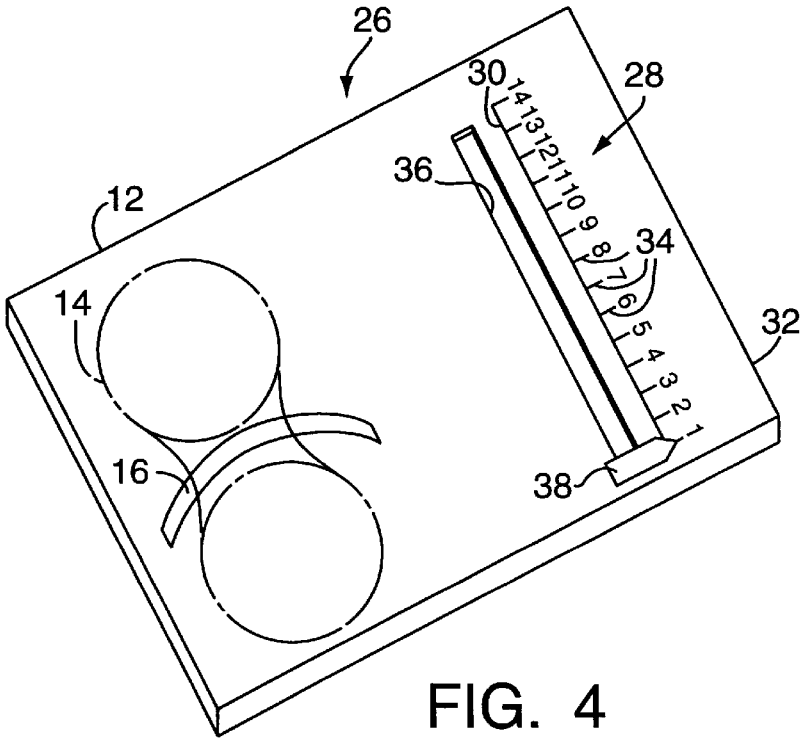
FIG. 4 is a perspective view of an alternate embodiment of the apparatus of the present invention.

Turning to FIG. 4, an alternate embodiment of the present invention is generally indicated by the reference numeral 26. In the illustrated embodiment the counter 28 includes a scale 30 defined by the support member 12. The scale 30 is positioned inwardly from and extends along an edge 32 of the support member 12 and defines reference marks 34, corresponding to increments of time, spaced at fixed intervals along the scale. The support member 12 also defines a slot 36 adjacent and approximately parallel to the scale 30. An indicator 38 is slidably received in the slot 36 and can be selectively aligned with a reference mark 34, thereby indicating the amount of time for which the pair of contact lenses have been worn.

Referring back to FIG. 1, the apparatus 10 of the present invention is used by first positioning the contact lens case 14 under the resilient member 16, thereby urging and releasably retaining the lens case against the support member 12. The counter 17 is then positioned to display the time interval corresponding to the length of time for which the contact lenses have been worn. For example, if the appropriate time interval is day 1, then the indicia 22 defined by the dials 18 are selectively aligned with the reference marks 24 defined by the support member 12 such that one dial indicates 0, and the other indicates 1, thereby displaying 01 to the user. Subsequently, whenever the particular pair of disposable contact lenses are placed in the contact lens case 14, for example, when they are being cleaned or removed for the evening, the wearer will be reminded of the length of time for which the lenses have been worn. The user will also be reminded to index the counter 17 to the next appropriate time increment.

While preferred embodiments have been shown and described, various modifications and substitutions may be made without departing from the spirit and scope of the invention. Accordingly, it is to be understood that the present invention has been described by way of example, and not by limitation.

What is claimed is:

1. An apparatus for tallying the length of time for which a pair of contact lenses have been worn, comprising:

a support member in the form of an approximately flat plate, said support member having an approximately planar surface adapted to receive a contact lens case;

means for releasably retaining the contact lens case on the approximately planar surface of the support member; and counting means coupled to the approximately planar surface of the support member for indicating the length of time for which the pair of contact lenses have been worn.

2. An apparatus for tallying the length of time for which a pair of contact lenses have been worn as defined by claim 1, wherein the means for releasably retaining the contact lens case on the support member includes a resilient strap coupled to the support member for overlying the contact lens case for urging the contact lens case against the approximately planar surface of the support member.

3. An apparatus for tallying the length of time for which a pair of contact lenses have been worn as defined by claim 1, wherein the means for releasably retaining the contact lens case on the approximately planar surface of the support member includes an adhesive strip coupled to the support member for releasably bonding the contact lens case to the support member.

4. An apparatus for tallying the length of time for which a pair of contact lenses have been worn as defined by claim 1, wherein the means for releasably retaining includes an adjustable strap coupled to the support member for retaining the contact lens case.

5. An apparatus for tallying the length of time for which a pair of contact lenses have been worn as defined by claim 1, wherein:

the counting means includes at least one dial rotatably coupled to the approximately planar surface of the support member and having an upper surface defining indicia angularly spaced at fixed intervals around the upper surface for indicating the amount of time for which the pair of contact lenses have been worn.

6. An apparatus for tallying the length of time for which a pair of contact lenses have been worn as defined by claim 5, wherein the counting means includes at least one reference mark defined by the support member and positioned adjacent to the at least one dial; and the indicia defined by the at least one dial are selectively alignable with the reference mark.

7. An apparatus for tallying the length of time for which a pair of contact lenses have been worn as defined by claim 1, wherein the counting means includes a scale extending along an edge of the support member and includes reference marks spaced at fixed intervals along the scale corresponding to increments of time; and wherein the counting means comprises;

an indicator adapted to be slidably received by the support member adjacent to the scale, the indicator being selectively alignable with the reference marks for displaying the amount of time for which the pair of contact lenses have been worn.

* * * * *